US011255307B2

(12) United States Patent
Kromer

(10) Patent No.: US 11,255,307 B2
(45) Date of Patent: Feb. 22, 2022

(54) FUEL INJECTION DEVICE

(71) Applicant: Robert Bosch GmbH, Stuttgart (DE)

(72) Inventor: Ralf Kromer, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/183,980

(22) Filed: Feb. 24, 2021

(65) Prior Publication Data

US 2021/0277860 A1 Sep. 9, 2021

(30) Foreign Application Priority Data

Mar. 9, 2020 (DE) ..... 102020202949.0

(51) Int. Cl.
*F02M 61/14* (2006.01)
*F02M 55/02* (2006.01)

(52) U.S. Cl.
CPC ..... *F02M 61/14* (2013.01); *F02M 55/025* (2013.01); *F02M 2200/856* (2013.01)

(58) Field of Classification Search
CPC . F02M 61/14; F02M 55/025; F02M 2200/856
USPC ..... 123/294, 456, 470
See application file for complete search history.

(56) References Cited

U.S. PATENT DOCUMENTS 5,970,953 A * 10/1999 Lorraine ..... F02M 61/14 123/470
6,276,339 B1 * 8/2001 Shebert, Jr ..... F02M 61/14 123/470
6,338,333 B1 * 1/2002 Brosseau ..... F02M 35/10085 123/456
6,640,784 B1 * 11/2003 Sims, Jr. ..... F02M 69/045 123/470
6,845,758 B2 * 1/2005 Seymour, II ..... F02M 61/14 123/470
6,846,023 B2 * 1/2005 Ebinger ..... F16L 37/1225 24/563
7,360,524 B2 * 4/2008 Zdroik ..... F02M 55/005 123/469
7,373,926 B2 * 5/2008 Eckbauer ..... F02M 55/00 123/470
7,444,992 B2 * 11/2008 Ricci ..... F02M 61/14 123/470

(Continued)

FOREIGN PATENT DOCUMENTS

DE 102005020380 11/2006
DE 102012206887 10/2013
WO WO-2009039021 A1 * 3/2009 ..... F02M 55/005

*Primary Examiner* — Sizo B Vilakazi
*Assistant Examiner* — Brian R Kirby
(74) *Attorney, Agent, or Firm* — Norton Rose Fulbright US LLP; Gerard Messina

(57) ABSTRACT

A fuel injection device includes at least one fuel injector and a receiving bore in a cylinder head as well as a receiving opening of a fuel rail for the fuel injector. The fuel injector is sealed using at least one sealing ring against the walls of the receiving opening and secured in the receiving opening with the aid of a fastening element. A compensating element is provided that acts on the fastening element to prevent bending moments as a result of an asymmetrical suspension of the fuel injector at the fastening element from acting on the fuel injector. The fuel injector device is particularly suitable for directly injecting fuel into a combustion chamber of a mixture-compressing, spark-ignition internal combustion engine.

8 Claims, 6 Drawing Sheets

(56) References Cited

U.S. PATENT DOCUMENTS 7,938,455 B2 * 5/2011 Rapp ..... F02M 55/002 285/305
8,469,004 B2 * 6/2013 Solferino ..... F02M 61/14 123/470
9,032,934 B2 * 5/2015 Nakamura ..... F02M 69/04 123/470
9,567,961 B2 * 2/2017 Cass ..... F02M 61/14
10,174,734 B2 * 1/2019 Reinhardt ..... F02B 1/02
10,648,439 B2 * 5/2020 Pohlmann ..... F02M 61/168
2009/0235899 A1 * 9/2009 Biasci ..... F02M 55/005 123/470
2010/0218743 A1 * 9/2010 Marc ..... F02M 61/168 123/470
2011/0030656 A1 * 2/2011 Pepperine ..... F02M 61/14 123/470
2012/0104120 A1 * 5/2012 Holt ..... F16F 1/32 239/533.2
2014/0231551 A1 * 8/2014 Serra ..... F02M 61/14 239/584
2015/0068497 A1 * 3/2015 Rehwald ..... F02M 61/20 123/456
2015/0090229 A1 * 4/2015 Lang ..... F02M 61/145 123/470
2016/0025053 A1 * 1/2016 Reinhardt ..... F02M 63/0012 239/584
2016/0177903 A1 * 6/2016 Di Domizio ..... F02M 61/14 123/470
2017/0138325 A1 * 5/2017 Roseborsky ..... F02M 69/465
2018/0038331 A1 * 2/2018 Carli ..... F02M 61/168
2018/0372045 A1 * 12/2018 Oh ..... F02M 61/168
2019/0170101 A1 * 6/2019 Pasquali ..... F02M 61/168
2020/0011280 A1 * 1/2020 Serra ..... F02M 61/14

* cited by examiner

FUEL INJECTION DEVICE

CROSS REFERENCE

The present application claims the benefit under 35 U.S.C. § 119 of German Patent Application No. DE 102020202949.0 filed on Mar. 9, 2020, which is expressly incorporated herein by reference in its entirety.

FIELD

The present invention is directed to a fuel injection device.

BACKGROUND INFORMATION

A conventional fuel injection device in which a fuel injector installed in a receiving bore of a cylinder head of an internal combustion engine is provided, is shown in FIG. 1 by way of example. On the inlet side, the fuel injector is inserted into a connecting piece of a fuel rail. The sealing of the fuel injector takes place via a sealing ring that is attached to a connecting piece (for example, as described in German Patent Application No. DE 10 2005 020 380 A1).

A fuel injection system for high-pressure injection in internal combustion engines that include a fuel distributor and multiple fuel injectors described in German Patent Application No. DE 10 2012 206 887 A1. Each fuel injector is situated at a cup of the fuel distributor. The fuel injectors are attached at the assigned cups with the aid of a fastening element in the shape of a so-called U-clip in each case. The fastening element has an at least essentially straight first leg and an at least essentially straight second leg. The cup has in turn at least one recess that extends as a through bore-hole through a wall of the cup, the first leg and the second leg being guided through the recesses. The connecting sleeve of the fuel injector furthermore has a collar that is supported at the cup at the first leg and at the second leg of the fastening element for the purpose of fastening the fuel injector. This makes it possible to safely and reliably fasten the fuel injector at the cup. However, it cannot be completely excluded that the fuel injector rests slightly asymmetrically on the fastening element, which may result in undesirable bending moments on the fuel injector.

SUMMARY

A fuel injection device according to an example embodiment of the present invention may have the advantage that bending moments that are potentially applied to the fuel injector as a result of non-uniform force effects may be reduced to a minimum. If the plane above the legs of a fastening element is not located exactly perpendicularly to the axis of the inlet connection of the fuel injector due to manufacturing, assembly and installation tolerances, thus possibly resulting in a bending moment on the fuel injector, a compensating element designed and situated according to the present invention may now compensate for that by tilting about the bearing surfaces established for this purpose. In this way, the supporting force introduced by the fastening element is introduced almost centrally to the valve longitudinal axis into the inlet connection. Due to the fact that the two bearing surfaces also allow for an axial movement in the direction of the two tilting axes, the compensating element may be guided, without distortion, at its outer diameter in the receiving opening of the connecting piece or at its inner diameter at the inlet connection.

The measures disclosed herein make advantageous refinements and improvements of the fuel injection device of the present invention possible.

The compensating element may advantageously have a two-part design including a top part and a bottom part. Each of the two parts optimally has a disk-shaped design, the top part being situated at a first bearing surface at the inlet connection of the fuel injector on the rail side and at a second bearing surface in the bottom part on the combustion chamber side. The bottom part additionally has two front surfaces protruding radially outward for support on the fastening element.

In a particularly advantageous manner, the axes of the two bearing surfaces of each compensating element are rotated toward one another by 90° about the valve longitudinal axis.

BRIEF DESCRIPTION OF THE DRAWINGS

Exemplary embodiments of the present invention are illustrated in the figures in a simplified manner and explained in greater detail in the description below.

DETAILED DESCRIPTION OF EXAMPLE EMBODIMENTS

Figure 1:
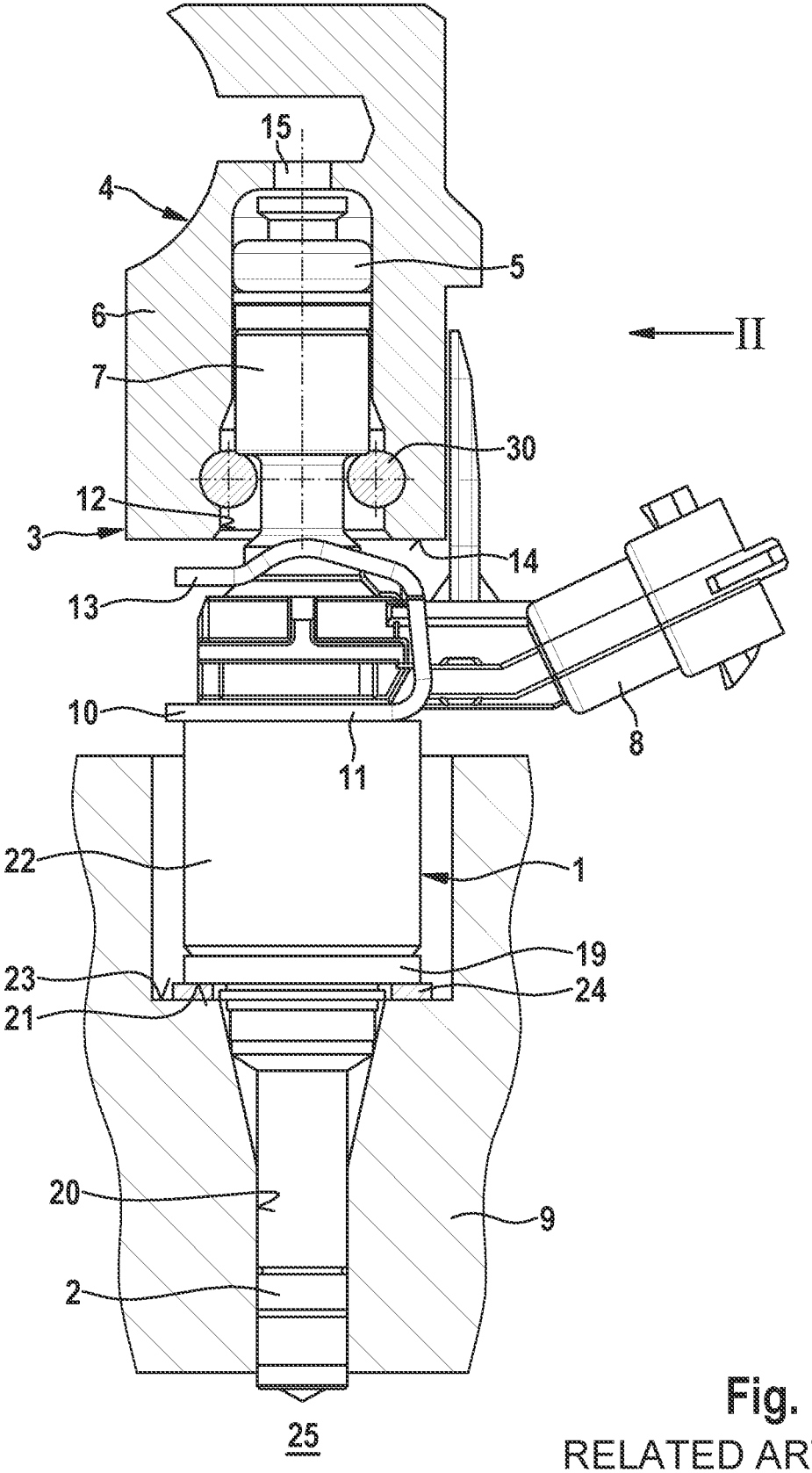
Fig. 1 RELATED ART
FIG. 1 shows a partially illustrated conventional fuel.

One conventional specific embodiment of a fuel injection device is described in greater detail in the following based on FIG. 1 for better understanding of the present invention. As one exemplary embodiment, a valve is illustrated in a side view in FIG. 1 in the form of an injector 1 for fuel injection systems of mixture-compressing, spark-ignition internal combustion engines. Fuel injector 1 is part of the fuel injection device. A downstream end of fuel injector 1, which is designed in the form of a directly injecting injector for directly injecting fuel into a combustion chamber 25 of the internal combustion engine, is installed in a receiving bore 20 of a cylinder head 9. A sealing ring 2, in particular made of Teflon®, ensures that fuel injector 1 is optimally sealed against the walls of receiving bore 20 of cylinder head 9.

Between a ledge 21 of a valve housing 22 (not shown) or a lower front surface 21 of a supporting element 19 and a shoulder 23 of receiving bore 20, which runs at a right angle to the longitudinal extension of receiving bore 20, for example, a flat intermediate element 24 is inserted that is designed in the shape of a flat washer. With the aid of such an intermediate element 24 or together with a stiff supporting element 19, which has a contact surface that is inwardly curved toward fuel injector 1, for example, manufacturing and assembly tolerances are compensated for and a mounting that is free of transverse forces is ensured even if fuel injector 1 is slightly tilted.

At its inlet-side end 3, fuel injector 1 has a plug connection to a fuel rail 4 that is sealed by a sealing ring 5 between a sectionally illustrated connecting piece 6 of fuel rail 4 and an inlet connection 7 of fuel injector 1. Fuel injector 1 is inserted into a receiving opening 12 of connecting piece 6 of fuel rail 4. Connecting piece 6 protrudes as one piece, for example, from actual fuel rail 4 and includes upstream from receiving opening 12 a flow opening 15, which has a smaller diameter and via which the inflow to fuel injector 1 takes place. Fuel injector 1 has an electric connecting plug 8 for the electrical contacting to actuate fuel injector 1.

In order to space fuel injector 1 and fuel rail 4 apart from one another in a largely radial force-free manner and to hold down fuel injector 1 safely in the receiving bore of cylinder head 9, a hold-down device 10 is provided between fuel injector 1 and connecting piece 6. Hold-down device 10 is designed as a yoke-shaped component, for example as a press-bending part. Hold-down device 10 includes a partially annular base element 11, from which a hold-down yoke 13 runs in a curved manner that rests in the installed state at a downstream end surface 14 of connecting piece 6 at fuel rail 4.

Figure 2:
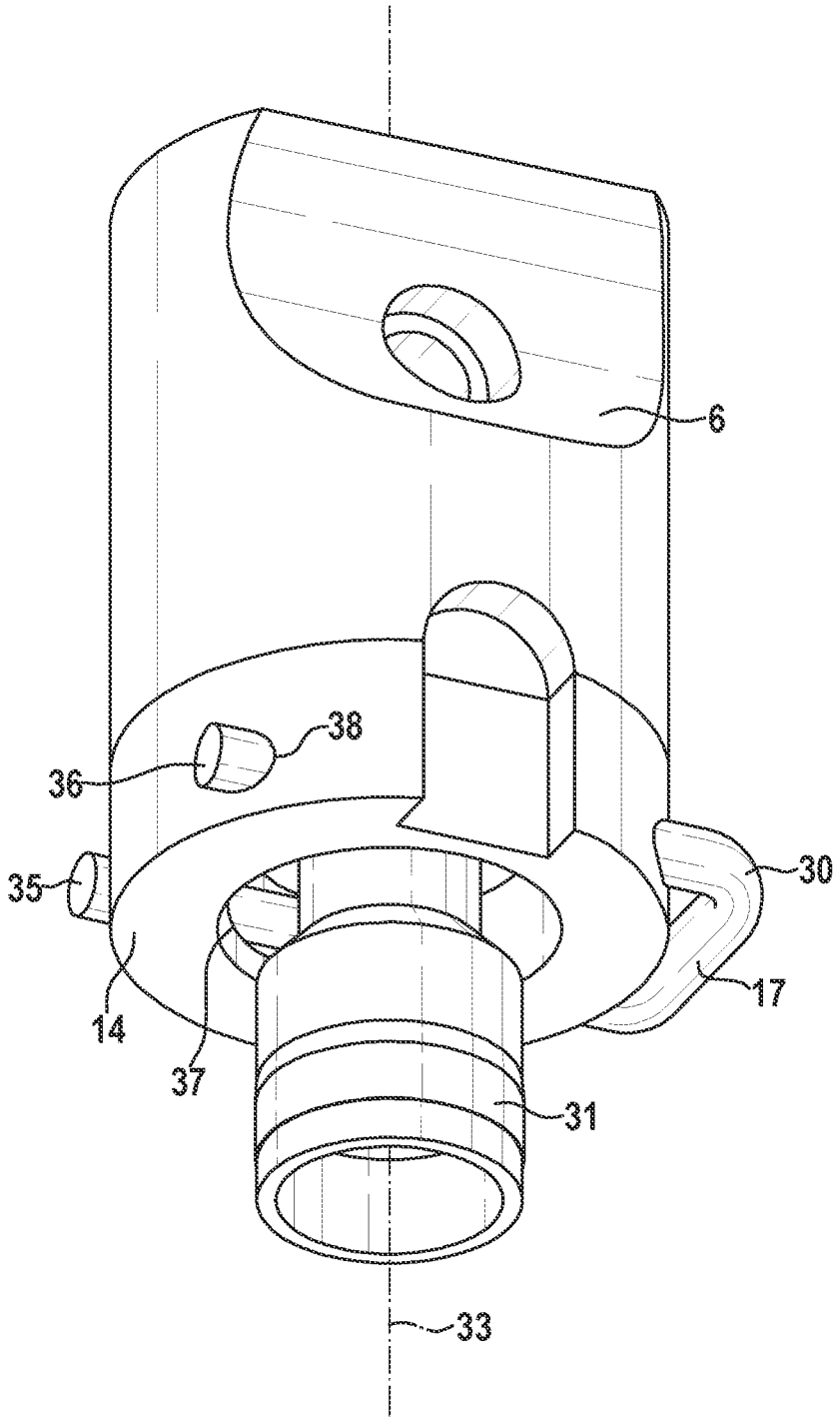
Fig. 2 RELATED ART
FIG. 2 shows a perspective side view in the direction of arrow II in FIG. 1 of a connecting piece of a fuel rail of the fuel injection device.

To secure fuel injector 1 in receiving opening 12, a fastening element 30 is in particular provided at a fuel injector 1 suspended in this receiving opening 12 (suspended injector solution). In FIG. 2, which illustrates a perspective side view in the direction of arrow II in FIG. 1, connecting piece 6 is shown in greater detail together with fuel injector 1 secured by fastening element 30.

A connecting sleeve 31, from which an excerpt is illustrated and which may be inlet connection 7, of fuel injector 1 is connected to connecting piece 6 via fastening element 30. In this case, fastening element 30, which is designed as a so-called U-clip, has at last essentially straight legs 35, 36 that are guided through at least one recess 37, 38 in the wall of connecting piece 6 in each case. Two opposite recesses 37, 38, which are designed as through bore-holes, are usually provided. Recesses 37, 38 are in this case located at least approximately in one plane that is oriented perpendicularly to a longitudinal axis 33 of connecting piece 6.

In the shown variant, fastening element 30 has a one-piece design, since the two legs 35, 36 are connected to one another via a connecting web 17 and thus form the already previously mentioned U-clip. First leg 35 and second leg 36 of fastening element 30 are oriented not quite in parallel to one another in an initial state, for example. With regard to a joining direction, in which legs 35, 36 of fastening element 30 are guided through recesses 37, 38 during the assembly, legs 35, 36 may slightly run toward one another or slightly diverge, for example, so that there is no exactly parallel design as a result. It is possible to insert legs 35, 36 into through bore-holes 37, 38 designed preferably in parallel to one another by spreading them apart or pressing them together in an appropriate manner. The result is thus a clamping force in the installed state. In this way, fastening element 30 is additionally secured against falling out of connecting piece 6. Impressions (not shown), which cooperate with a corresponding collar of connecting sleeve 31 of fuel injector 1 for optimal suspension, may additionally be provided at legs 35, 36. Alternatively to the U-clip, fastening element 30 may also be designed from two individual pins forming legs 35, 36.

Figure 3:
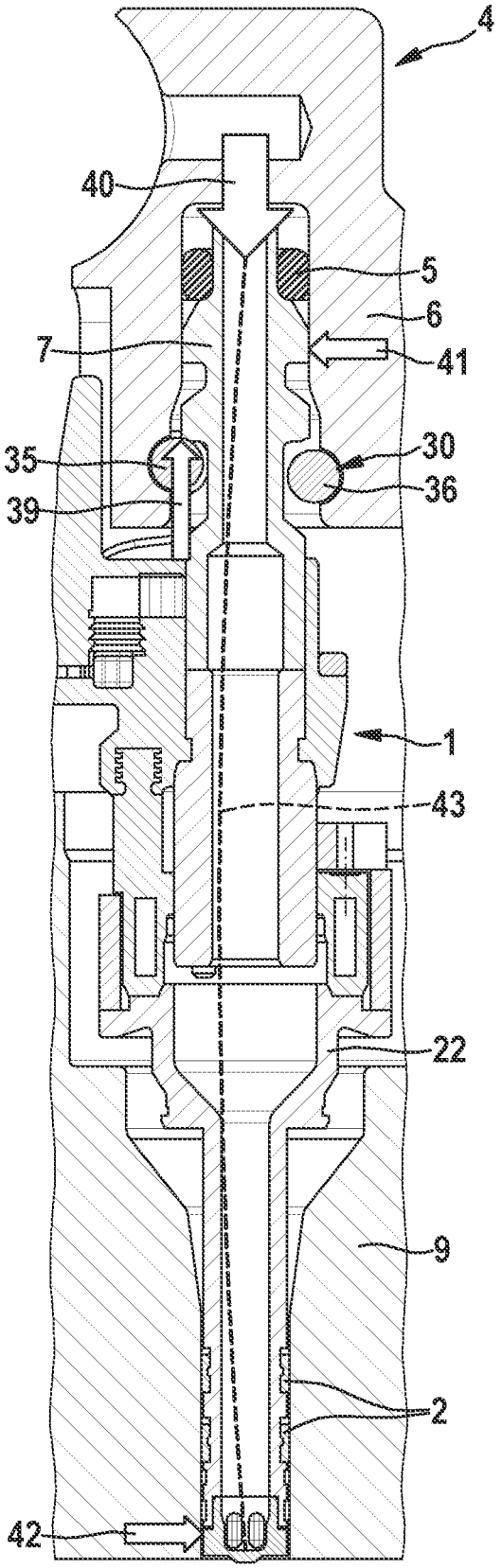
FIG. 3 shows a sectional view of a fuel injection device including a fuel injector, which is completely mounted and installed and secured using a fastening element, in a schematic illustration of the issue of the force effects.

A fuel injector 1 that is completely mounted and installed in a receiving bore 20 of cylinder head 9 and in a receiving opening 12 of connecting piece 6 of fuel rail 4 and secured using a fastening element 30 is sectionally illustrated in FIG. 3, this illustration demonstrating the issue of the force effects. Due to the manufacturing, assembly and installation tolerances, the two legs 35, 36 of fastening element 30 are not exactly in parallel to the contact surface of connecting sleeve 31 of fuel injector 1. This may result in that the collar of connecting sleeve 31 rests only on one of the two legs 35, 36 of fastening element 30 in the extreme case. The unilateral axial support is symbolically indicated by arrow 39, however the different heights of the two legs 35, 36 are plotted in a completely exaggerated manner and not true to scale for the purpose of demonstrating the issue. The unilateral support may result in that axial forces act on fuel injector 1 as a result of the system pressure, demonstrated by arrow 40 for the hydraulic force, which in turn may result in a bending moment on fuel injector 1 (demonstrated by arrows 41, 42 and dashed bending line 43). Bending line 43 is also shown bent in a considerably exaggerated manner for the purpose of demonstrating the issue. The object of the present invention is to reduce this potentially occurring bending moment to a minimum.

Figure 4:
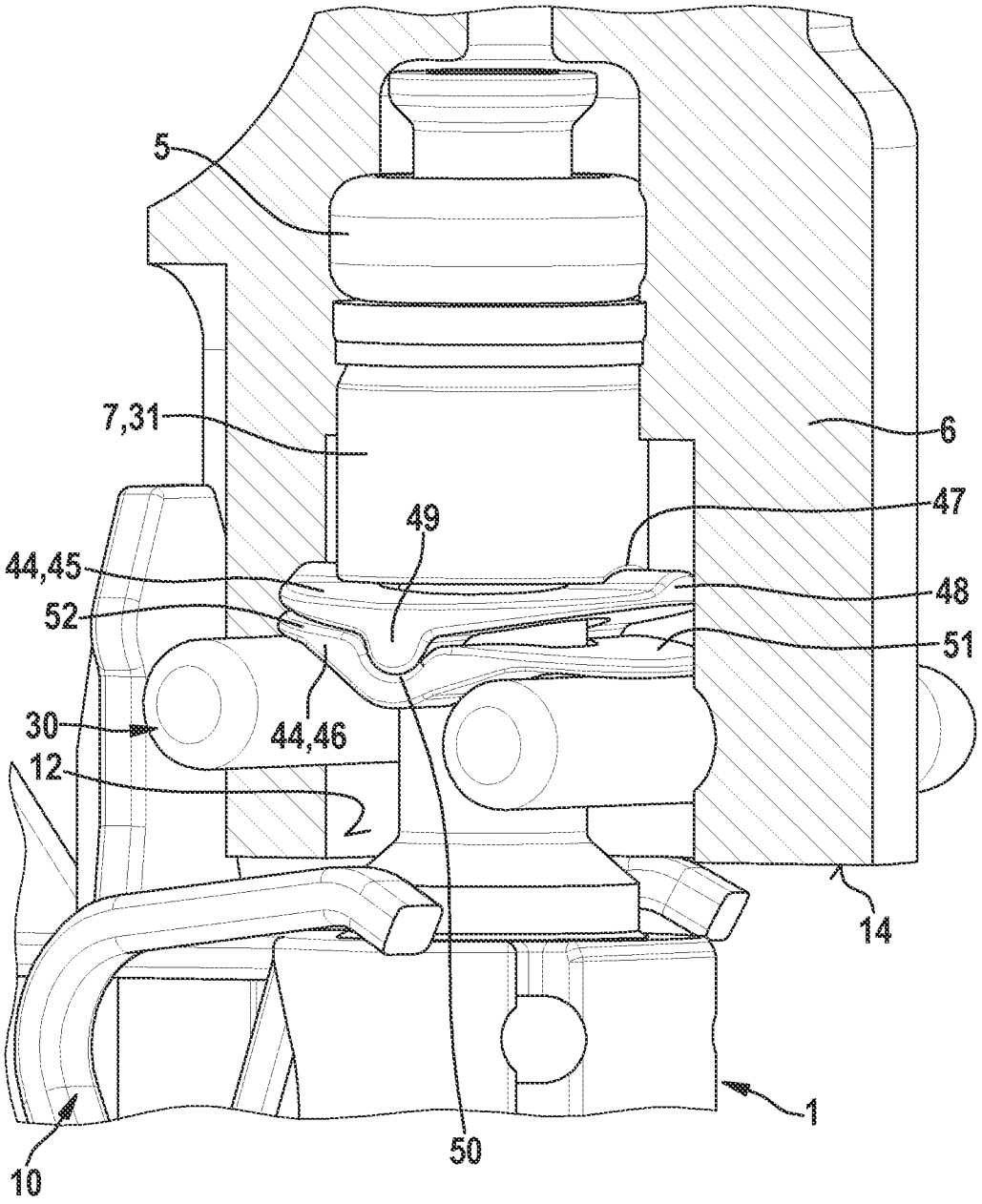
FIG. 4 shows a first exemplary embodiment of a compensating element designed and mounted according to the present invention at a fuel injector suspended with the aid of a fastening element in a partial sectional view through the connecting piece of the fuel rail.

FIG. 4 shows a first exemplary embodiment of a compensating element 44 provided and designed according to the present invention at a fuel injector 1 suspended with the aid of a fastening element 30 in a partial sectional view through connecting piece 6 of fuel rail 4. In this embodiment, compensating element 44 has a two-part design, including a top part 45 and a bottom part 46, each surrounding inlet connection 7 or connecting sleeve 31 and being situated above fastening element 30. Inlet connection 7 preferably has a concave bearing surface 47 as the supporting surface for top part 45 of compensating element 44. The axis of rotation of this bearing surface 47 runs perpendicularly through the valve longitudinal axis and is preferably rotated by 90° in relation to the assembly direction of fastening element 30. On the rail side, preferably disk-shaped top part 45 of compensating element 44 has a nose-type convex area 48, which forms the counterpart to bearing surface 47 in inlet connection 7, and on the combustion chamber side, a convex area 49, which forms the counterpart to a bearing surface 50 in bottom part 46 of compensating element 44 having a likewise disk-shaped design. The axes of these two bearing surfaces 47, 50 are rotated by 90° about the valve longitudinal axis with regard to one another. The axes of rotation of these two bearing surfaces 47, 50 preferably cross on the valve longitudinal axis. On the rail side, bottom part 46 of compensating element 44 has a preferably concave bearing surface 50 and on the combustion chamber side, two front surfaces 51, 52 protruding radially outward for support on fastening element 30. The axis of rotation of this second bearing surface 50 runs perpendicularly through the valve longitudinal axis. The two front surfaces 51, 52 are preferably at the same height as the two axes of rotation named above.

If the plane above legs 35, 36 of fastening element 30 is not located exactly perpendicularly to the axis of inlet connection 7 due to manufacturing, assembly and installation tolerances, thus possibly resulting in a bending moment on fuel injector 1, two-part compensating element 44 may compensate for that by tilting about the two bearing surfaces 47, 50. In this way, the supporting force introduced by fastening element 30 is introduced almost centrally to the valve longitudinal axis into inlet connection 7. Due to the fact that the two bearing surfaces 47, 50 also allow for an axial movement in the direction of the two tilting axes, compensating element 44 may be guided, without distortion, at its outer diameter in receiving opening 12 of connecting piece 6 or at its inner diameter at inlet connection 7.

Figure 5:
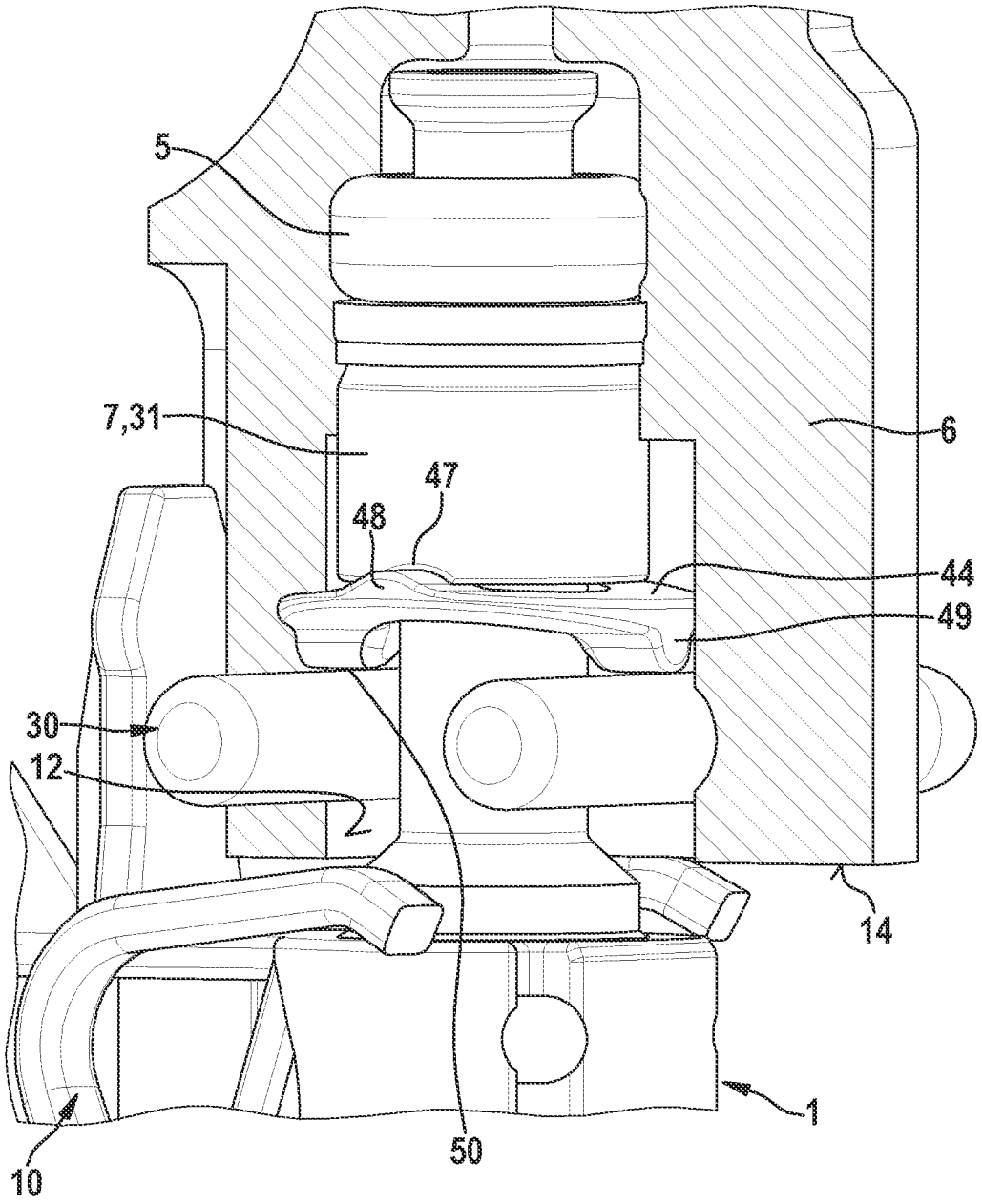
FIG. 5 shows a second exemplary embodiment of a compensating element designed and mounted according to the present invention at a fuel injector suspended with the aid of a fastening element in a partial sectional view through the connecting piece of the fuel rail.

FIG. 5 shows a second exemplary embodiment of a compensating element 44 designed and installed according to the present invention at a fuel injector 1 suspended with the aid of a fastening element 30 in a partial sectional view through connecting piece 6 of fuel rail 4. In the case of this embodiment, compensating element 44 has a one-piece design. Here, compensating element 44 largely corresponds to top part 45 of compensating element 44 of the embodiment according to FIG. 4. Inlet connection 7 preferably has a concave bearing surface 47 as the supporting surface for compensating element 44. The axis of rotation of this bearing surface 47 runs perpendicularly through the valve longitudinal axis and is designed in parallel in the assembly direction of fastening element 30. On the rail side, preferably disk-shaped compensating element 44 has a nose-type convex area 48, which forms the counterpart to bearing surface 47 in inlet connection 7, and on the combustion chamber side, a convex area 49, which forms a bearing surface 50 directly on legs 35, 36 of fastening element 30. The axes of these two bearing surfaces 47, 50 are rotated by 90° about the valve longitudinal axis with regard to one another. The axes of rotation of these two bearing surfaces 47, 50 preferably cross on the valve longitudinal axis. Opposite two-piece compensating element 44, the axial force is now introduced on fastening element 30 only largely selectively.

Figure 6:
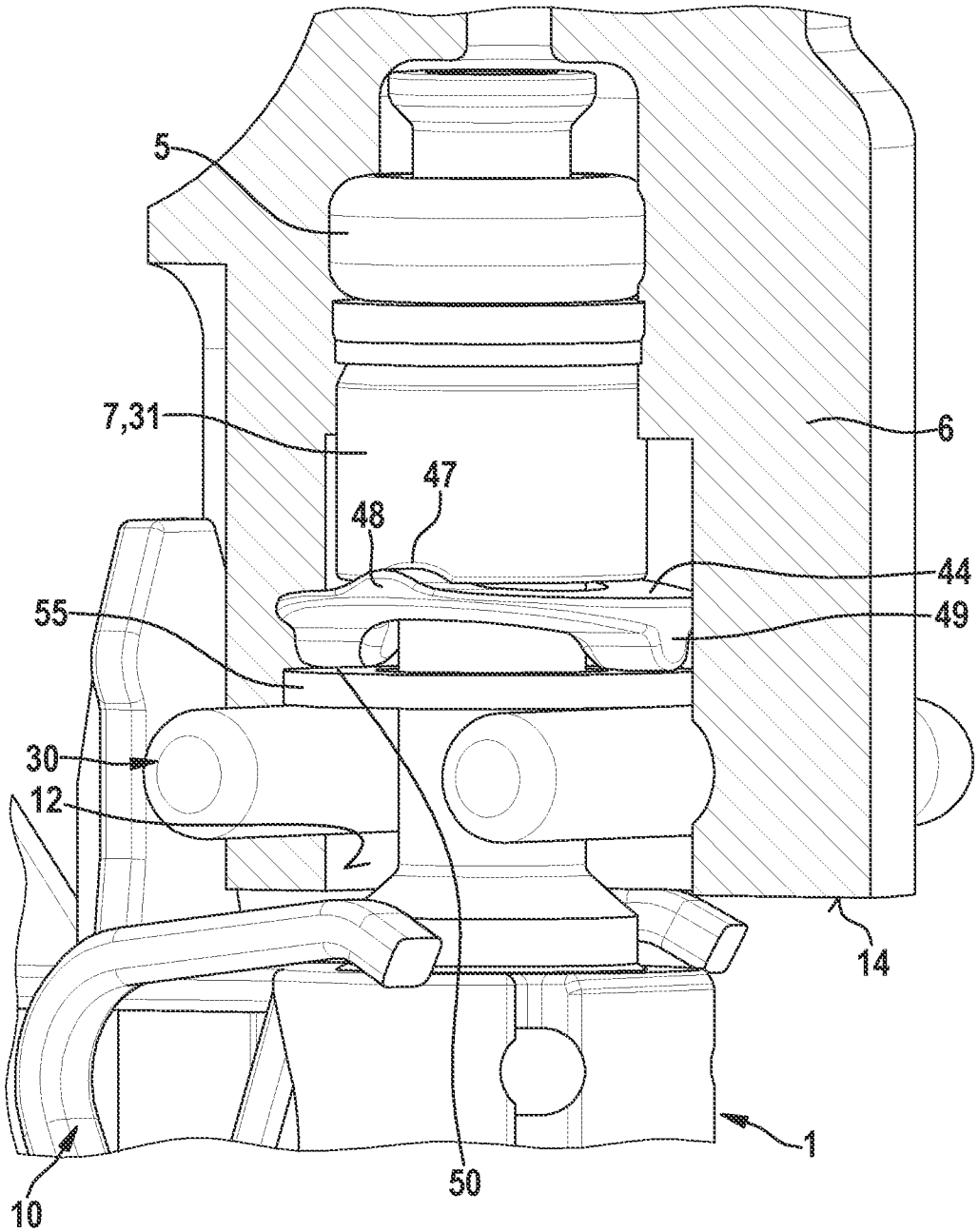
FIG. 6 shows a third exemplary embodiment of a compensating element designed and mounted according to the present invention at a fuel injector suspended with the aid of a fastening element in a partial sectional view through the connecting piece of the fuel rail.

FIG. 6 shows a third exemplary embodiment of a compensating element 44 designed and installed according to the present invention at a fuel injector 1 suspended with the aid of a fastening element 30 in a partial sectional view through connecting piece 6 of fuel rail 4. This compensating element 44 corresponds to the second exemplary embodiment of compensating element 44 shown in FIG. 5. In order to avoid that compensating element 44 is punctually mounted directly on legs 35, 36 of fastening element 30, a disk 55 is provided, however, that has a planar design on both sides and is inserted between compensating element 44 and fastening element 30. This planar disk 55 ensures a linear transmission of force instead of a point transmission of force into fastening element 30.

What is claimed is:

1. A fuel injection device for a fuel injection system of internal combustion engines, for directly injecting fuel into a combustion chamber, the fuel injection device comprising:

at least one fuel injector;

a fuel rail having an inlet side receiving opening for the fuel injector, the fuel injector being sealed using at least one sealing ring against walls of the receiving opening and being secured in the receiving opening using a fastening element; and a compensating element that acts on the fastening element, wherein the compensating element is shaped in such a way that it forms first and second bearing surfaces together with the fuel injector and with the fastening element, wherein the compensating element is a two-piece compensating element and the second bearing surface is formed for the compensating element at a bottom part of the two-piece compensating element, wherein a top part of the two-piece compensating element and a bottom part of the two-piece compensating element have a disk-shaped design in each case, wherein the top part is mounted at the second bearing surface in the bottom part, wherein the bottom part has two front surfaces protruding radially outward for support on the fastening element.

2. The fuel injection device as recited in claim 1, wherein the receiving opening for the fuel injector is formed in a connecting piece of the fuel rail.

3. The fuel injection device as recited in claim 2, wherein the fastening element is a component that is made up of two pin-type legs and that has a one-piece or two-piece design, and that traverses the receiving opening in the connecting piece of the fuel rail for securely suspending the fuel injector.

4. The fuel injection device as recited in claim 1, wherein the compensating element that acts on the fastening element has a disk-shaped configuration and surrounds an inlet connection or a connecting sleeve of the fuel injector in an installed state.

5. The fuel injection device as recited in claim 1, wherein on a rail side, the compensating element includes a nose-type convex area that forms a counterpart to the first bearing surface at the fuel injector.

6. The fuel injection device as recited in claim 5, wherein on a combustion chamber side, the compensating element includes a convex area that forms a counterpart to the second bearing surface.

7. The fuel injection device as recited in claim 6, wherein the second bearing surface is formed for the compensating element either directly at the fastening element or at a thin disk inserted between the compensating element and the fastening element.

8. The fuel injection device as recited in claim 1, wherein axes of the two bearing surfaces are rotated by 90° about a valve longitudinal axis with regard to one another.

* * * * *